US005483616A

United States Patent [19]

Chiu et al.

[11] Patent Number: 5,483,616

[45] Date of Patent: Jan. 9, 1996

[54] HUMIDIFIER TANK WITH IMPROVED HANDLE

[75] Inventors: Bernard Chiu, Wellesley, Mass.; Jui-Shang Wang, Taipei, Taiwan; Stanley Gresens, Homewood, Ill.

[73] Assignee: Duracraft Corporation, Whitinsville, Mass.

[21] Appl. No.: 360,473

[22] Filed: Dec. 21, 1994

[51] Int. Cl.[6] ..... B05B 1/24

[52] U.S. Cl. ..... 392/406; 392/404

[58] Field of Search ..... 392/394, 403, 392/404, 405, 406; 422/305, 306

[56] References Cited

U.S. PATENT DOCUMENTS

| | | | |
|---|---|---|---|
| 2,369,623 | 2/1945 | Utley | 392/405 |
| 2,639,365 | 5/1953 | Krampe et al. | 392/404 |
| 4,752,423 | 6/1988 | Wong | 392/403 |
| 5,247,604 | 9/1993 | Chiu | 392/406 |

*Primary Examiner*—Teresa J. Walberg
*Assistant Examiner*—Sam Paik
*Attorney, Agent, or Firm*—John E. Toupal; Harold G. Jarcho

[57] ABSTRACT

A humidifier with a removable water tank having a carrying handle projecting downwardly from the tank's bottom surface to a plane parallel therewith and below a downwardly projecting outlet valve. The handle facilitates transport of the tank with the bottom surface facing upwardly and support of the tank on a horizontal support surface.

16 Claims, 7 Drawing Sheets

HUMIDIFIER TANK WITH IMPROVED HANDLE

BACKGROUND OF THE INVENTION

This invention relates generally to a portable humidifier and, more specifically, to a portable humidifier with an improved water tank.

Various types of humidifiers are used to provide moisture to indoor air. Included among such humidifiers are ultrasonic humidifiers, steam humidifiers or vaporizers, and evaporative humidifiers.

Ultrasonic humidifiers employ a high-speed oscillator, positioned a given distance below the water surface, to energize the water and break it into a fine mist. A fan carries the mist into the surrounding environment. It is critical that the distance from the oscillator to the water level be accurately maintained to ensure that the oscillation energy is efficiently transferred to the water. A drop in water level can result in permanent damage to the oscillator. The water level generally is maintained by the use of an inverted water tank such as that described in U.S. Pat. Nos. 5,210,818 and 5,247,604. The tank is sealed and includes a carrying handle on its top surface while a bottom surface includes an opening to which a cap is attached. When the tank is inverted beneath a spigot and the cap is removed the opening serves as a fill opening. Often the cap includes a valve system which seals the fill opening unless the tank is properly positioned on a humidifier base and the valve is engaged by a valve actuator in the base. The valve actuator opens the valve and allows water to escape from the tank into a reservoir defined by the base. Discharging water is exchanged for air which enters the tank through the same opening. As water flows into the base reservoir, the water level rises until it seals the valve and prevents air from getting into the tank. At this level, which is the normal operating water level for the humidifier, water flow from the tank ceases. The design of the humidifier is established to position the oscillator that given distance below this level. As the oscillator and fan cause dispersal of moisture from the reservoir, the water level attempts to drop creating a pathway for air into the tank and in turn allowing the release of a proportional amount of water from the tank into the reservoir to thereby return the water level to the normal operating level. This process repeats itself continually until the water supply in the tank is depleted, at which time the water level begins to drop increasingly lower. A float sensing shut-off switch mechanism senses the abnormally low water level and turns the humidifier off before the water level drops low enough to cause damage to the oscillator. This basic system is well known and often practiced in ultrasonic humidifiers of the prior art.

Evaporative humidifiers come in several varieties. Some employ absorbent belts continuously rotating through first a water reservoir and then an air stream to cause humidity. Some employ pumps to lift water from a reservoir and pour it over a porous media through which air flows to cause similar humidification, and some employ wicking pads which are positioned partially below water level and partially above. In such humidifiers, the water level must be maintained for a different reason than that of the ultrasonic humidifier. Specifically, it is important that water level be maintained to ensure consistent humidity efficiency and maximum moisture output. Wick pads generally are capable of drawing water from the reservoir water level to a given height through capillary action. A relatively smaller portion of the wick pad must be positioned below the water level where water is absorbed, than above where air flowing through the pad causes the desired humidification. Excessive height of the pad above that height to which water will be drawn not only constitutes wasted wick material and is therefor inefficient by design, but also reduces the humidification efficiency of the humidifier by allowing a pathway for air which does not pass through the moistened portion of the pad, essentially constituting air leakage which reduces the total humidification rate. For this reason, wick type evaporative humidifiers are often designed to maintain a given water level which ensures that the most efficient amount of the wick pad lies above and below the water level to maximize efficiency and output. Accordingly, a water tank similar to that described above often is used with evaporative humidifiers.

Steam humidifiers cause humidity by boiling water into vapor. A submersible heating element depends from a humidification unit into a boiling chamber within a base. A water tank similar to that described above is positioned on the base to both feed water to the boiling chamber and to maintain a given normal operating level therein. The boiling water maintains the temperature of the heating element at approximately two hundred and twelve degrees fahrenheit. It is important that the water level be maintained high enough to fully submerge the heating element, and not be allowed to drop while the heating element is energized or overheating will occur. A float sensing shut-off switch mechanism senses an abnormally low water level as the water tank is depleted and turns the heating element off before excessive overheating occurs.

Most of the tanks described above and known in the prior art include a handle projecting from a tank top surface. Such positioning of the handle requires that the tank be carried from the humidifier to the spigot cap with the fill opening facing down. It is common for some leakage to occur from the cap during such movement. It is also common that, after being carried to a water supply, the tanks are rested on a surface with the fill opening facing down. Although usually protruding precariously from the bottom surface of the tank, prior cap/valve assemblies have not generally provided a great amount of structural support, and being that a filled water tank is relatively heavy, the weight of the tank resting on the cap/valve assembly can subject the valve to an enormously high amount of stress. Consequently, permanent damage to valves is relatively common and often results in water spillage that damages furnishings.

It is the object of the present invention to overcome the deficiencies of the prior art and provide a humidifier tank having a tank support structure which serves both to protect the delicate cap/valve assembly and provides a means by which the tank can be carried hole side up to prevent leakage during transport.

SUMMARY OF THE INVENTION

The present invention is a humidifier water tank having a handle on its top surface and a fill opening on its bottom surface onto which a cap/valve assembly is attached. The bottom surface further includes a support structure by which the tank can be rested hole side down while keeping the valve assembly off of the supporting surface to prevent damage. The support structure further serves as a handle by which the tank can be carried with the fill openings to face upwardly to prevent leakage.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
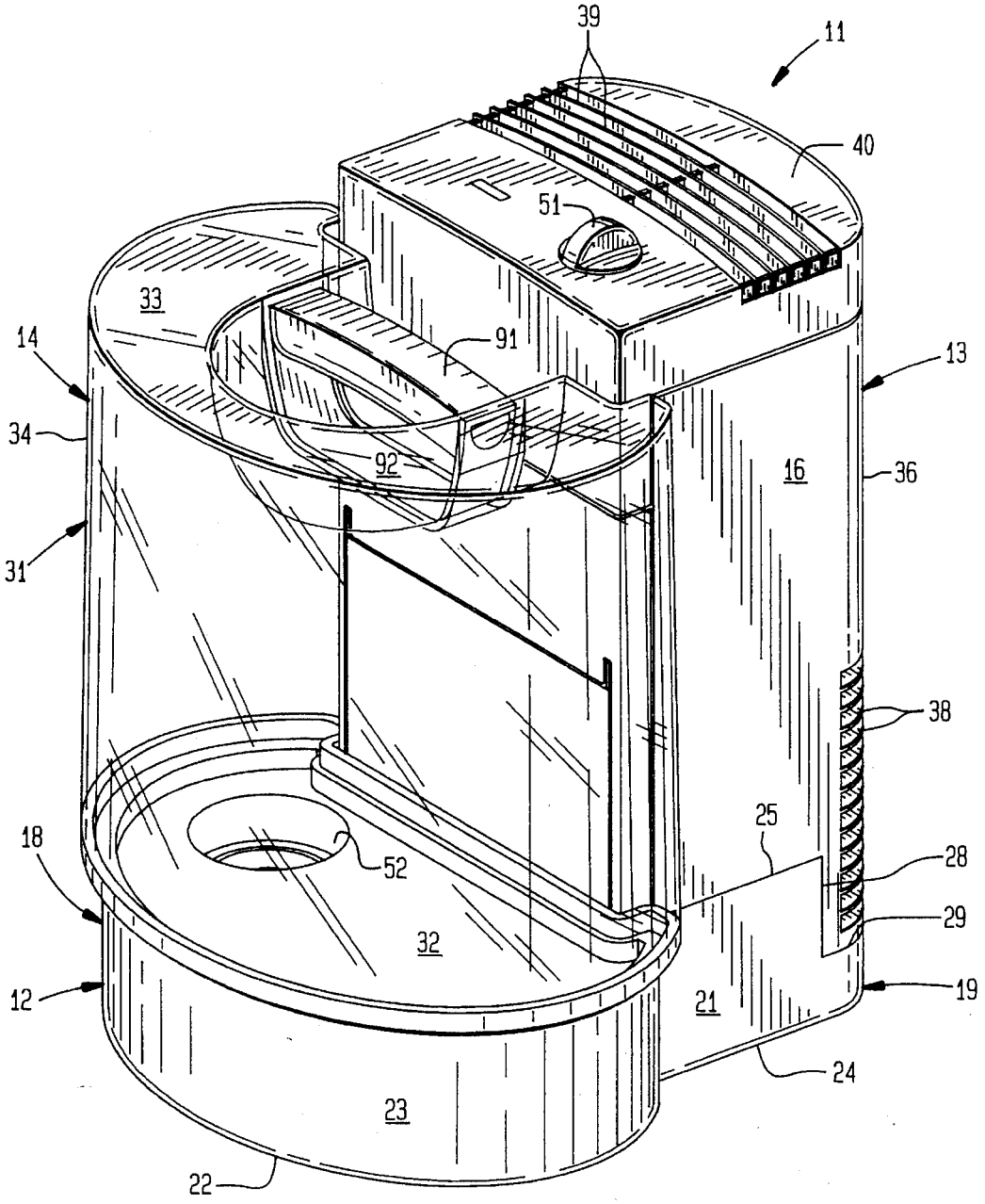
FIG. 1 is a front perspective view of a humidifier according to the invention.
Figure 2:
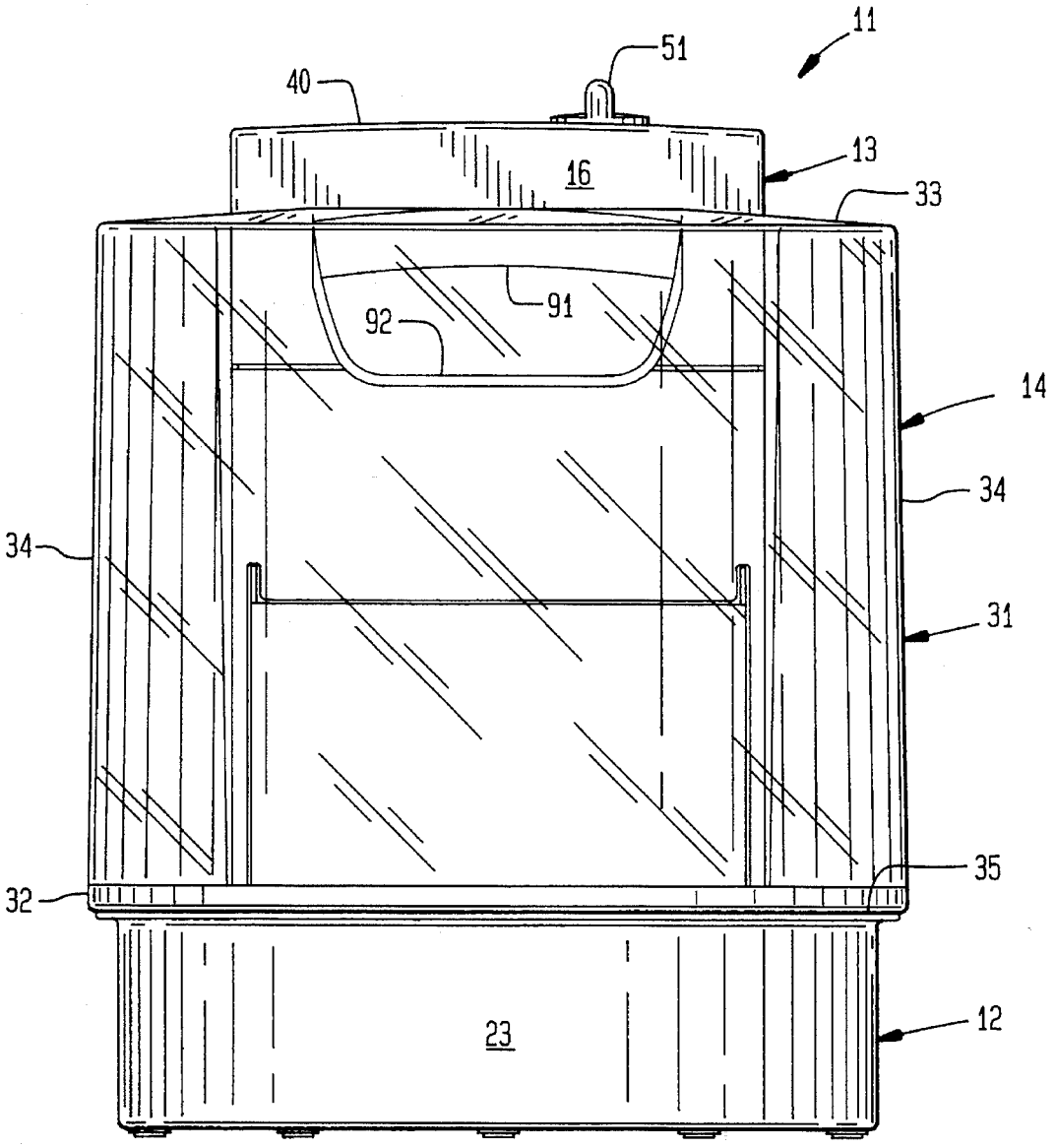
FIG. 2 is a front elevational view of the humidifier.
Figure 3:
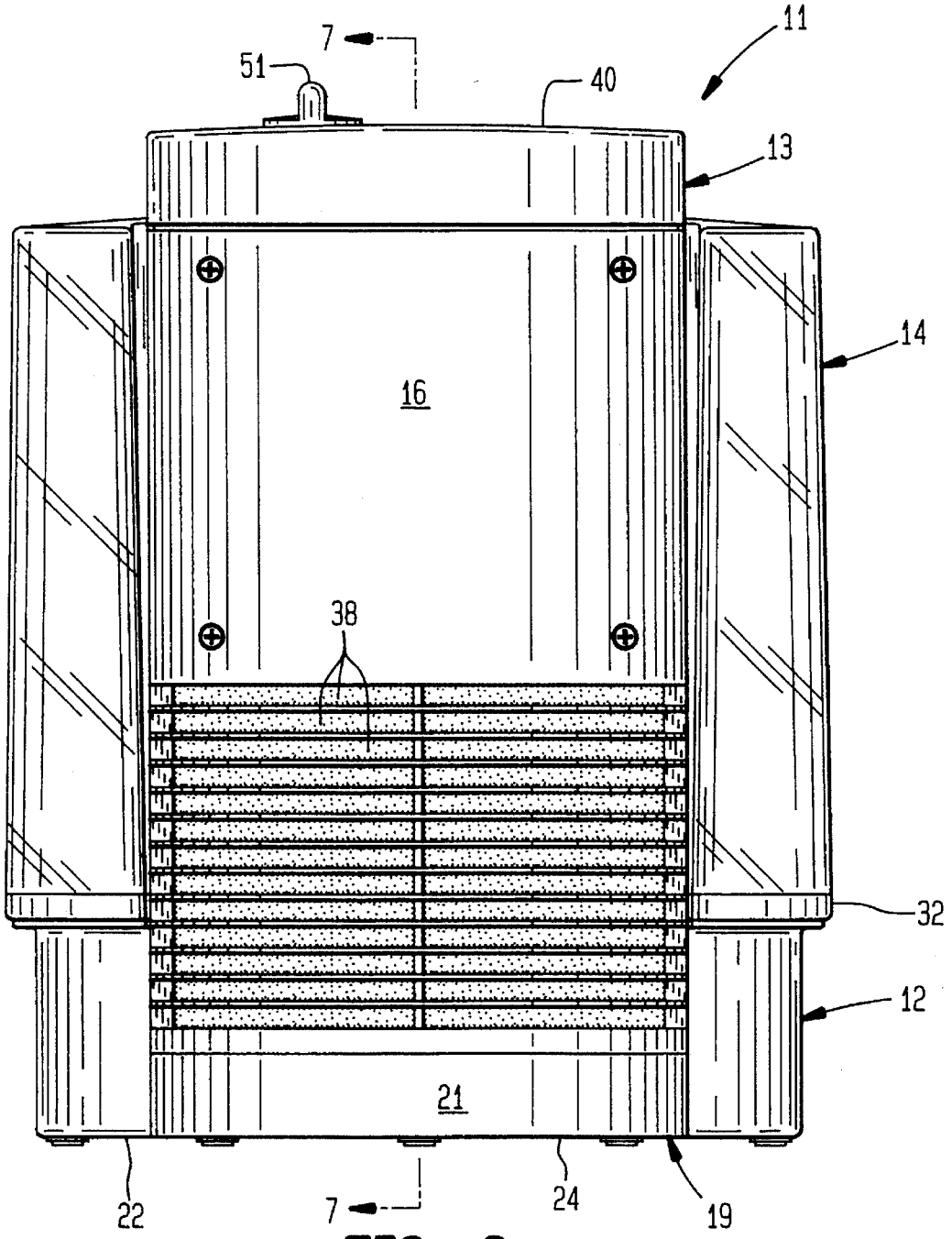
FIG. 3 is a rear elevational view of the humidifier.
Figure 4:
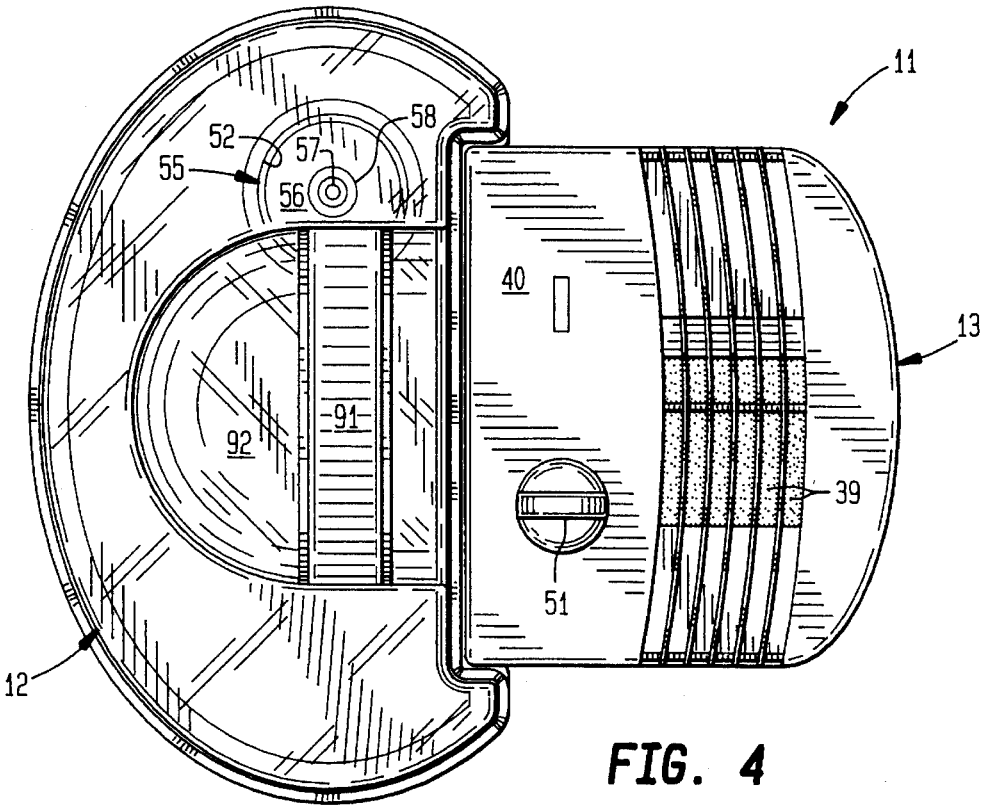
FIG. 4 is a top view of the humidifier.
Figure 5:
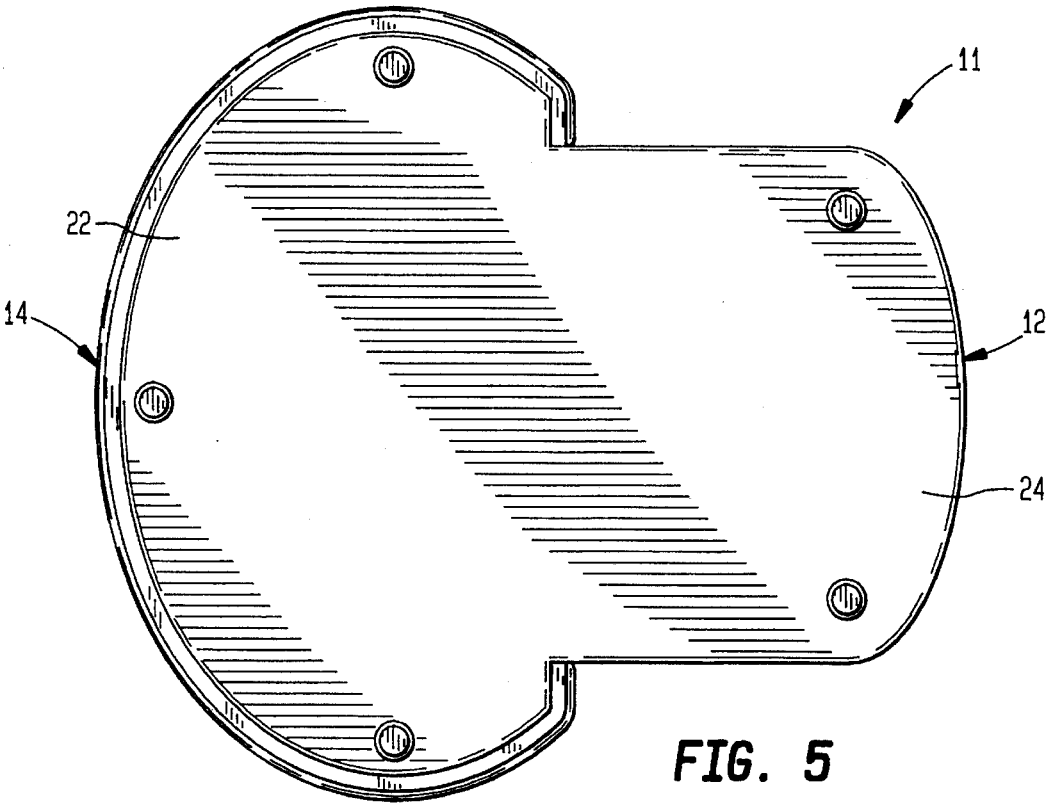
FIG. 5 is a bottom view of the humidifier.
Figure 6:
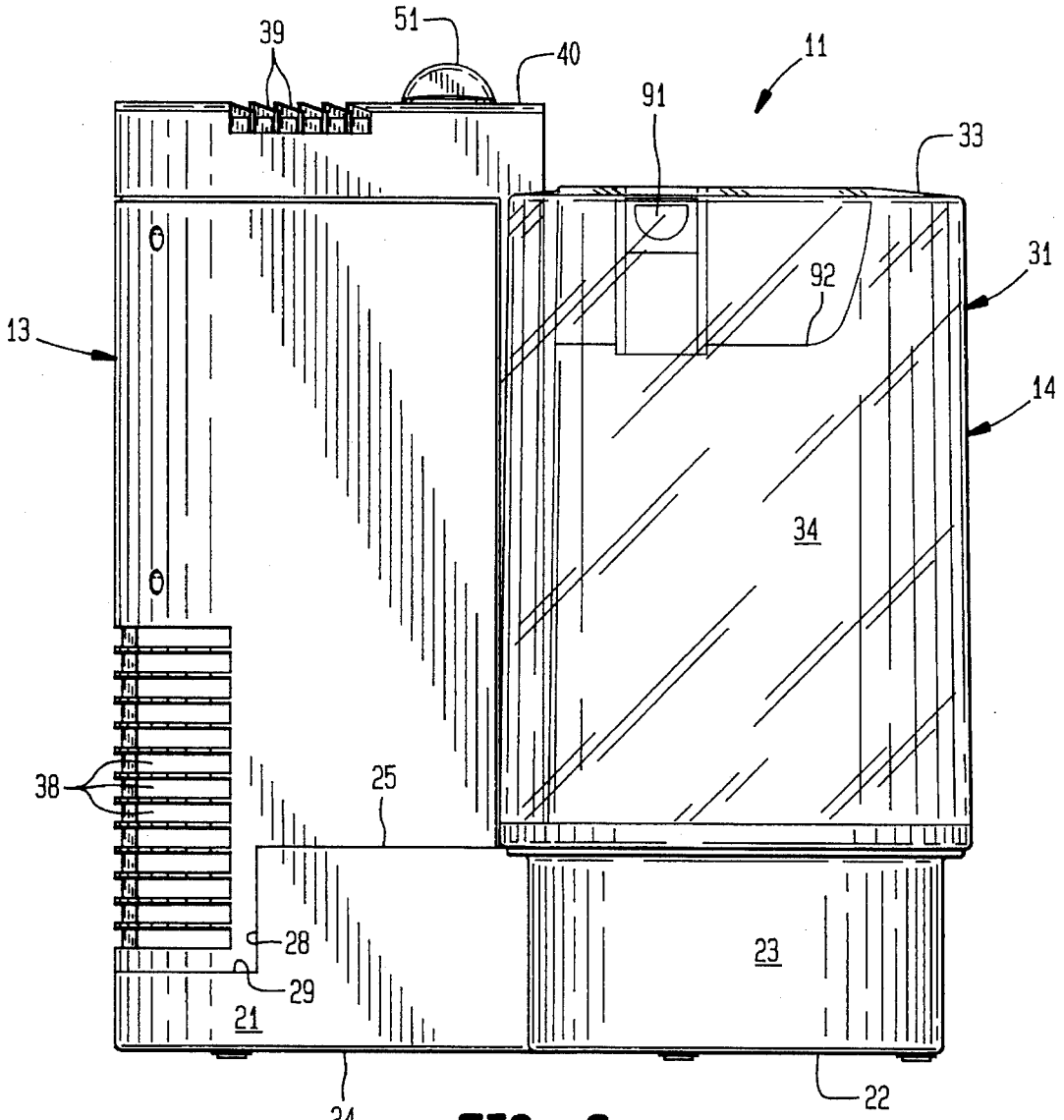
FIG. 6 is a left side elevational view of the humidifier.

A humidifier 11 includes a base 12, and a humidification unit 13 having an upright housing portion 16 and a removable water tank 14 both mounted on the base 12. The base 12 is generally key-shaped from top view including a circular portion 18 and a rectangular portion 19 as shown in FIG. 1. A peripheral wall 23 extends upwardly from a circular bottom surface 22 of the base 12, and an upright housing portion 21 projects upwardly from a bottom surface 24 of the rectangular portion 19. Extending upwardly from the peripheral wall 21 of the base 12 is a horizontal top surface 25 of the upright housing portion 19. An inner vertical wall 28 projects downwardly from the horizontal top surface 25 to meet an outer upper edge 29 of the rectangular portion 19.

The tank 14 includes an inverted cup-shaped housing 31 and a lid portion 32 permanently sealed in an open bottom end thereof and forming a bottom wall. A substantially planar top wall 33 of the tank 14 is joined to the bottom wall 32 by vertical side wall portions 34 of the housing 31. The horizontally positioned lid portion 32 is supported on a top edge 35 of the peripheral wall 23 of the base portion 12. Extending through an outer peripheral wall 36 of the housing portion 16 are air intake openings 38 while exhaust openings 39 project through a horizontal top surface 40 thereof.

Figure 7:
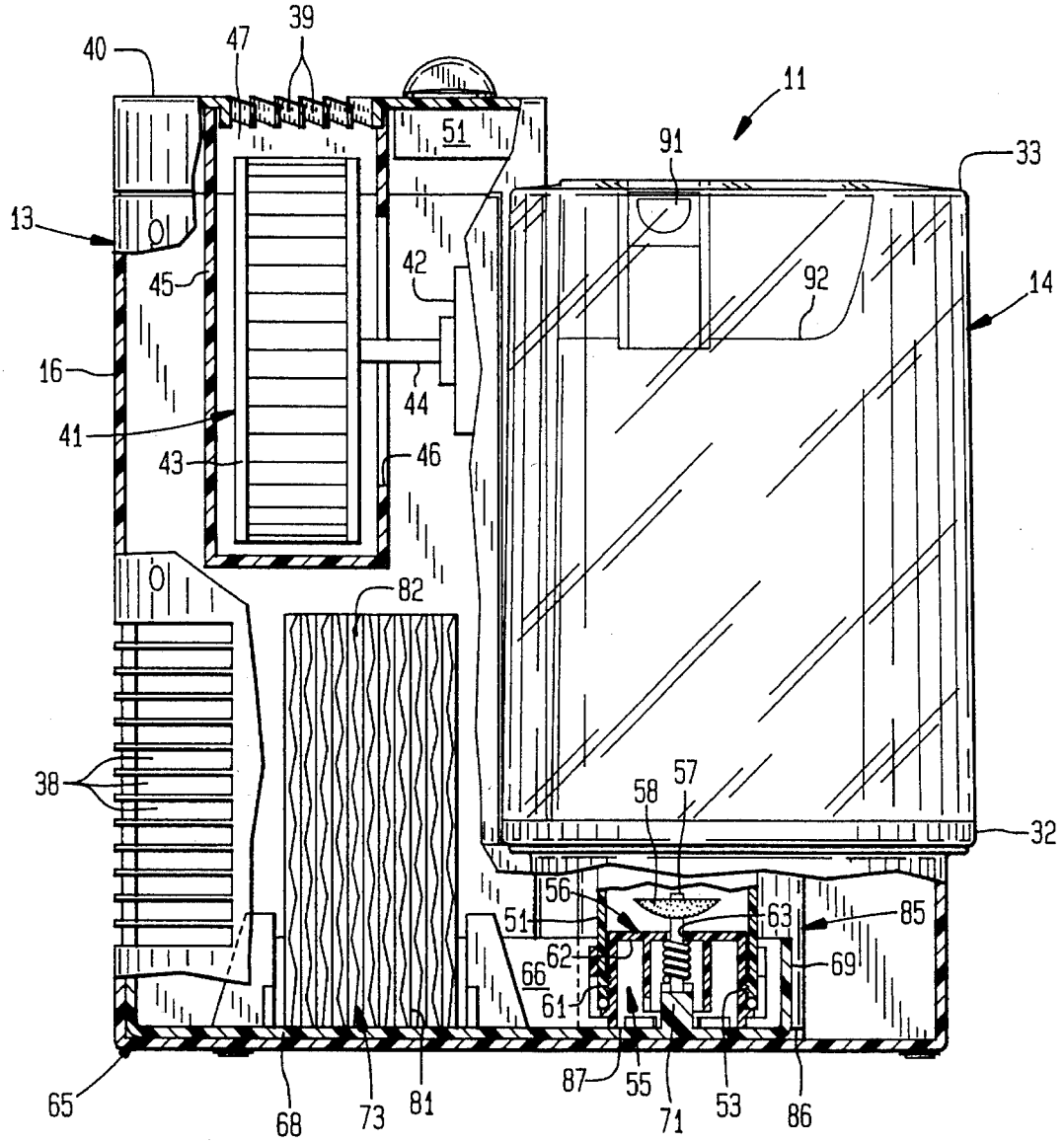
FIG. 7 is a cross-sectional view taken along lines 7—7 in FIG. 2.
Figure 8:
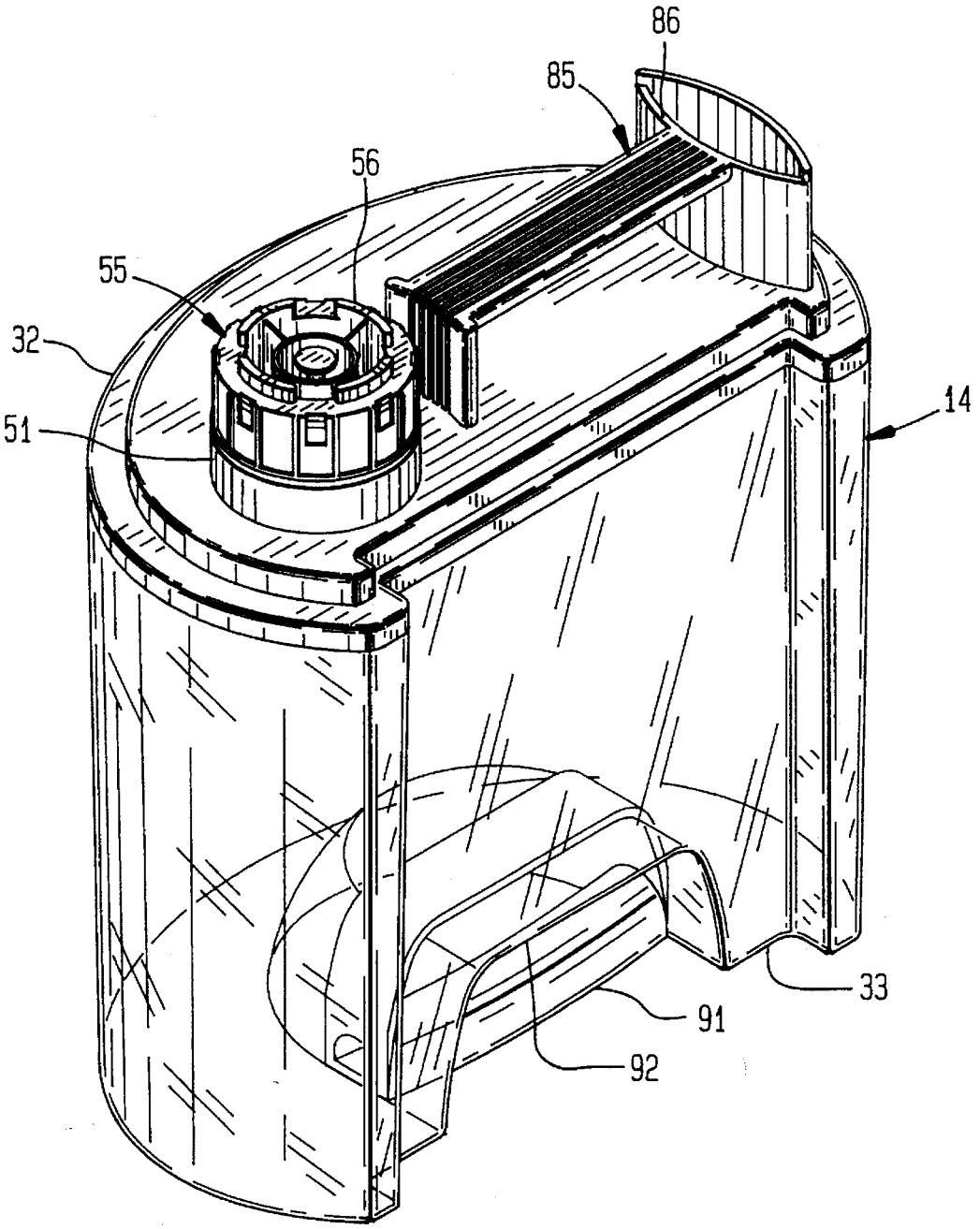
FIG. 8 is a perspective view of a water tank used in the humidifier shown in FIGS. 1–7.

As shown in FIG. 7, a blower assembly 41 is mounted below the horizontal top surface 40 and within the housing 16. Included is the blower assembly 41 is a motor 42, a horizontally oriented cylindrical blower wheel 43 mounted on a motor shaft 44, and a blower housing 45. Defined by the blower housing 45 are an air intake opening 46 and an exhaust opening 47 aligned with and adjacent to the exhaust openings 39 of the upright housing 16. When a control switch 51 mounted on the horizontal top surface 25 is closed, the motor 42 is energized to produce rotation of the shaft 44. Resultant spinning of the blower wheel 43 draws air into the housing 16 through the intake openings 38, through the interior of the housing 16, through the intake opening 46 of the blower housing 45, and then out of the humidifier 11 through the air exhaust opening 47 of the blower housing 45 and the exhaust openings 39 in the horizontal top surface 40.

Depending downwardly from the lid 32 of the tank 14 is a tubular projection 51 with a hollow interior defining female threads 53 (FIG. 7). The tubular projection 51 together with an adjacent opening 52 (FIG. 1) through the lid 32 constitute a water fill opening and discharge opening for the tank 14. A cap/valve assembly 55 is engaged within the threads 53 of the tubular projection 51. The cap/valve assembly 55 consists of a cylindrical cap 56, a valve plunger 57, a rubber valve seal 58, and a compression spring 59. Formed on the cylindrical cap 56 are an outer male threaded cylindrical wall 61, a horizontal circular bottom wall 62 and an axial discharge opening 63. The valve plunger 57 is loosely positioned through the opening 63 to allow axial movement of the plunger 57 relative the cap 56. Attached to the top end of the valve plunger 57 is the valve seal 58 and the spring 59 is compressed between the cap 56 and a lower end of the plunger 57 to bias the rubber valve seal 58 towards the axial discharge opening 63.

Within the base 12 is removably positioned a tray 65 defining a reservoir 66. The tray 65 has a "tee" shaped horizontal bottom surface 68 with a peripheral wall 69 extending upwardly therefrom. Also extending upwardly from the horizontal bottom surface 68 of the tray 65 is a cylindrical valve actuator post 71 positioned directly below and concentric with the cap/valve assembly 55 of the tank 14. Within the reservoir 66 and in the rectangular portion 19 of the base 12 is positioned an evaporative wick pad 73 which extends upwardly into the upright housing portion 16 and within an airstream path therethrough.

After being filled with water and attached to the cap/valve assembly 55, the tank 14 is positioned on the peripheral wall 23 of the base 12. With the tank 14 in that position, the valve actuator 59 in the reservoir 66 pushes the valve plunger 57 upwardly to remove the rubber valve seal 58 away from the axial discharge opening 63 of the cap 56. Water then flows from the tank 14 through the axial discharge opening 63 into the reservoir 66. As water escapes from the tank 14, air simultaneously enters the tank through the axial opening 63. The water level rises until reaching the level of the horizontal bottom wall 62 of the cap 56. At that time water seals the air path into the tank 14 and preventing further discharge of water from the tank 14.

Water in the reservoir 66 is absorbed by a lower portion 81 of the wicking pad 73 and drawn by capillary action upward into an upper portion 82 thereof. The water in the upper portion 82 is subjected to the airstream through the upright housing 16 which airflow accelerates the evaporation of moisture and causes the humidification desired of the humidifier 11. As water is depleted from the reservoir 66 by this humidification, the water level attempts to fall, but thereby exposes the horizontal bottom wall 62 of the cap 56 to allow air to enter the tank 14 and water to thereby escape therefrom. In this manner, the water in the reservoir 66 is maintained at its normal operating level until such time as the tank's water supply has been depleted.

Also included as an integral part of the lid 32 on the tank 14 is a lower handle 85 projecting downwardly therefrom. An outer extremity 86 of the lower handle 85 is aligned substantially with an outer extremity 87 of the downwardly projecting cap/valve assembly 55. The lower handle 85 facilitates transport of the tank 14 with the assembly facing upwardly to thereby prevent inadvertent spillage of water through the discharge opening 63. When using the lower handle 85, the planar top wall 33 of the housing 31 accommodates support of the tank 14 on a suitable support surface. In addition, the lower handle 85 can function as a support for the tank 14 when removed from the base 12 and positioned on a flat surface. The support provided by the lower handle reduces the possibility of damage to the valve assembly 55 of undesirable tipping over of the tank 12. Also, the lower handle 85 can be alternatively used in conjunction with an upper handle 91 projecting upwardly from a recessed surface 92 in the top wall 33 of the tank 14. The two handles 85, 91 permit the use of two hands to more readily accommodate transport of the tank 14 when filled and relatively heavy.

Obviously, many modifications and variations of the present invention are possible in light of the above teachings. It is to be understood, therefore, that the invention can be practiced otherwise than as specifically described.

What is claimed is:

1. A portable humidifier comprising:

base means defining a reservoir for retaining a water supply;

humidification means for drawing moisture from said reservoir and discharging said moisture into the environment;

a tank supported by said base means and having an outlet opening communicating with said reservoir; said tank having a bottom wall, a top wall, and side walls joining said top and bottom walls;

a first handle projecting from said bottom wall; and a second handle projecting from said top wall.

2. A humidifier according to claim 1 wherein said first handle and said second handle are integrally formed with said tank.

3. A humidifier according to claim 1 wherein said outlet opening is disposed in said bottom wall.

4. A humidifier according to claim 3 wherein said first handle and said second handle are integrally formed with said tank.

5. A humidifier according to claim 1 wherein said top wall is substantially planar.

6. A humidifier according to claim 1 wherein said bottom wall defines a fill opening and tube means projecting downwardly from said fill opening.

7. A humidifier according to claim 6 wherein said tube means, said first handle and said second handle are formed integrally with said tank.

8. A humidifier according to claim 6 wherein said tube means comprises an outer tube extremity, and said first handle comprises an outer handle extremity substantially aligned with said outer tube extremity.

9. A humidifier according to claim 8 wherein said tube means, said first handle and said second handle are formed internally with said tank.

10. A humidifier according to claim 8 including a cap threadedly engaged with said tube means, and a valve retained by said cap and defining said outlet opening.

11. A humidifier according to claim 10 wherein said tube means, said first handle and said second handle are formed integrally with said tank.

12. A humidifier according to claim 6 wherein said top wall is substantially planar.

13. A portable humidifier comprising:

base means defining a reservoir for retaining a water supply;

humidification means for drawing moisture from said reservoir and discharging said moisture into the environment;

a tank supported by said base means and having an outlet opening communicating with said reservoir; said tank having a bottom wall, a top wall, and side walls joining said top and bottom walls;

tube means projecting downwardly from said bottom wall and defining a fill opening; and handle means projecting downwardly from said bottom wall and wherein said tube means comprises a downwardly projecting tube extremity, and said handle means comprises a downwardly projecting handle extremity substantially vertically aligned with said tube extremity.

14. A humidifier according to claim 13 wherein said tube means and said handle means are formed integrally with said tank.

15. A humidifier according to claim 13 wherein said top wall is substantially planar.

16. A humidifier according to claim 15 wherein said tube means and said handle means are formed integrally with said tank.

* * * * *